US007195656B2

(12) United States Patent
Appleby et al.

(10) Patent No.: US 7,195,656 B2
(45) Date of Patent: Mar. 27, 2007

(54) METHOD FOR COMBUSTION OF PULVERIZED COAL WITH REDUCED EMISSIONS

(75) Inventors: Donald Benjamin Appleby, Cincinnati, OH (US); Joia Kirin Spooner-Wyman, Cincinnati, OH (US)

(73) Assignee: Procter & Gamble Company, Cincinnati, OH (US)

( * ) Notice: Subject to any disclaimer, the term of this patent is extended or adjusted under 35 U.S.C. 154(b) by 405 days.

(21) Appl. No.: 10/612,354

(22) Filed: Jul. 2, 2003

(65) Prior Publication Data

US 2005/0000150 A1 Jan. 6, 2005

(51) Int. Cl.
*C10L 1/18* (2006.01)
*C10L 1/182* (2006.01)
*C10L 1/185* (2006.01)

(52) U.S. Cl. ..... 44/447; 44/449; 44/350

(58) Field of Classification Search ..... 44/447, 44/448, 449, 451, 388, 445, 308, 500, 502
See application file for complete search history.

(56) References Cited

U.S. PATENT DOCUMENTS

| | | | | |
|---|---|---|---|---|
| 913,713 | A | 3/1909 | Ege | |
| 1,447,095 | A | 2/1923 | McArthur | |
| 3,332,755 | A * | 7/1967 | Kukin | 44/603 |
| 4,304,636 | A * | 12/1981 | Kestner et al. | 44/620 |
| 4,332,593 | A | 6/1982 | Burgess et al. | |
| 4,753,661 | A | 6/1988 | Nelson et al. | |
| 5,308,365 | A | 5/1994 | Kesling, Jr. et al. | |
| 5,425,790 | A | 6/1995 | Liotta, Jr. et al. | |
| 5,454,842 | A | 10/1995 | Poirier et al. | |
| 5,476,971 | A | 12/1995 | Gupta | |
| 5,578,090 | A | 11/1996 | Bradin | |
| 6,174,501 | B1 | 1/2001 | Noureddini | |
| 2003/0027014 | A1 | 2/2003 | Johnson et al. | |
| 2004/0168365 | A1 | 9/2004 | Hundley | |

FOREIGN PATENT DOCUMENTS

| | | | |
|---|---|---|---|
| EP | 105237 | * | 4/1994 |
| EP | 0649829 | A1 | 4/1995 |
| GB | 1246853 | | 12/1968 |
| GB | 1 392 984 | | 5/1975 |

* cited by examiner

*Primary Examiner*—Cephia D. Toomer
(74) *Attorney, Agent, or Firm*—Stephen T. Murphy; Laura Grunzinger; Kim W. Zerby

(57) ABSTRACT

Fuel compositions containing (a) pulverized coal; and (b) an oxygenate selected from glycerol, glycerol derivatives, propylene glycol, propylene glycol derivatives, ethylene glycol, ethylene glycol derivatives, fatty acid alkyl esters, fatty alcohols, and mixtures thereof. Methods of reducing the NOx emissions generated from the burning of pulverized coal in a heat-producing unit, wherein the method comprises the steps of: (a) introducing pulverized coal into a combustion chamber of the heat-producing unit; and (b) co-firing the pulverized coal with an oxygenate source selected from glycerol, glycerol derivatives, propylene glycol, propylene glycol derivatives, ethylene glycol, ethylene glycol derivatives, fatty acid alkyl esters, fatty alcohols, and mixtures thereof, where the combustion of the oxygenate source generates at least 2.5%, on a heat input basis, of the total heat generated by the co-firing.

2 Claims, No Drawings

METHOD FOR COMBUSTION OF PULVERIZED COAL WITH REDUCED EMISSIONS

FIELD OF INVENTION

The present invention relates to a method of combusting coal for the generation of heat and power that results in reduced emission of oxides of nitrogen (NOx) which consists of a co-firing pulverized coal, preferably in a boiler or furnace system, with an effective amount of an oxygen-containing organic compound.

BACKGROUND OF THE INVENTION

The demands of an industrialized society and the consequent need to burn fuel for the generation of energy tend to compromise air quality. Existing fuels that are burned in boiler systems and furnaces to produce heat and power include distillate fuel oil, residual (number 6) fuel oil, blends of distillate and residual fuel oil, and coal. Many of the existing energy sources, particularly fossil fuels such as petroleum and coal, release substantial amounts of pollutants, such as nitrogen oxides (NOx), sulfur oxides (SOx), carbon monoxide (CO) and particulate matter (PM) upon combustion. These pollutants cause respiratory diseases and other human ailments. These pollutants also poison the environment via acid rain, ground level ozone and greenhouse gases.

Being the least expensive and available in relative abundance, coal is the preferred fuel in many instances. Unfortunately however, the combustion of coal generates substantial quantities of harmful pollutants, such as sulfur dioxide, oxides of nitrogen, carbon monoxide and particulates. Fuels other than coal often have fewer effects on air quality, but tend to be more expensive, or be in relatively short supply.

Environmental legislation, such as the Clean Air Act in the United States, has been enacted in many countries to control the amount of various chemicals released into the atmosphere in an effort to protect human health and the environment. At a local or regional level, industry is typically regulated by state or regional environmental protection agencies that set limits as to the amounts of airborne pollutants that can be emitted from a given source.

As energy demands increase, the pressures, conflicts and costs involved in supplying that energy without exacerbating these health and environmental problems become increasingly difficult.

In recent years, much work has been conducted on finding ways of reducing the output of NOx and SOx and other pollutants from coal combustion. The most common means of reducing NOx emissions is the use of Selective Catalytic Reduction (SCR) technology. However, this approach requires the construction of an expensive catalytic system to treat the exhaust gases from the combustion process. This approach may not be cost effective for smaller coal fired furnaces or boilers.

Another approach is to use staged combustion to reduce NOx wherein there are more than one individualized combustion zones in the furnace. While this technique is suitable for the construction of a new furnace, it is not easily or inexpensively retrofitted to existing furnaces.

Yet another approach is the use of additives during the combustion process to effect changes in the combustion conditions such that emissions are reduced. In one method, calcium compounds such as CaO, CaCO3, CaF, etc, are added to the combustion zone to effect the reduction in NOx and SOx emissions. However, this and similar techniques result in a slag disposal issue.

Another method of reducing NOx emissions (at the point of exit from the stack) is to combine another fuel having less NOx emissions per heating unit value, such as fuel oil, in a furnace or boiler, with the coal. Such combination can reduce the overall NOx emissions while providing the same or similar overall heating values. Although this method often permits coal-burning facilities to meet air quality regulations, it is simply a substitution of a more expensive, but less NOx emitting fuel for the coal. The fuel oil does not actually reduce the emissions of the coal itself, but rather, reduces the emissions from the heating system itself.

In short, notwithstanding previous attempts to solve the emissions problems associated with the combustion of fossil fuels, especially coal, there is a continuing need to develop coal burning methods that improve the NOx emissions, can be cost-effectively retrofitted to existing heat-producing units, such as furnaces and boilers.

SUMMARY OF THE INVENTION

It has now surprisingly been discovered that the combination of pulverized coal and an effective amount of oxygenate, when burned as fuel to produce heat, will provide greater-than substitution effect reductions of emissions of NOx from the heat-generating unit.

Therefore the present invention relates to fuel compositions providing reduced emissions of NOx when combusted, wherein the composition comprises:

a) pulverized coal; and b) an oxygenate selected from the group consisting of, glycerol, glycerol derivatives, propylene glycol, propylene glycol derivatives, ethylene glycol, ethylene glycol derivatives, fatty acid alkyl esters, fatty alcohols, and mixtures thereof.

The present invention also relates to methods of reducing the NOx emissions generated from the burning of pulverized coal in a heat-producing unit, wherein said method comprises the steps of:

a) introducing pulverized coal into a combustion chamber of the heat-producing unit; and b) co-firing the pulverized coal with an oxygenate source selected from the group consisting of glycerol, glycerol derivatives, propylene glycol, propylene glycol derivatives, ethylene glycol, ethylene glycol derivatives, fatty acid alkyl esters, fatty alcohols, and mixtures thereof;

wherein combustion of the oxygenate source generates at least 2.5%, on a heat input basis, of the total heat generated by the co-firing.

DETAILED DESCRIPTION OF THE INVENTION

While the specification concludes with the claims particularly pointing and distinctly claiming the invention, it is believed that the present invention will be better understood from the following description.

All percentages and ratios used herein are by weight of the total composition and all measurements made are at 25° C., unless otherwise designated.

All cited references are incorporated herein by reference in their entirety.

The compositions and methods of the present invention can include, consist essentially of, or consist of, the components of the present invention as well as other ingredients described herein. As used herein, "consisting essentially of" means that the composition or component may include additional ingredients, but only if the additional ingredients do not materially alter the basic and novel characteristics of the claimed compositions or methods.

All percentages, parts and ratios are based upon the total weight of the compositions of the present invention, unless otherwise specified. All such weights as they pertain to listed ingredients are based on the active level and, therefore, do not include carriers or by-products that may be included in commercially available materials, unless otherwise specified.

It has now been found that the co-firing, in a combustion zone, of pulverized coal with a selected oxygenate source is useful for reducing the NOx emissions normally associated with coal burning.

Without being limited by theory, it is believed that the oxygenate synergistically reacts with the fired coal, resulting in a reduction in the NOx emissions attributed to the nitrogen found in the coal structure. Fuel-bound nitrogen is the source of approximately 80% of the NOx emissions from uncontrolled combustion of pulverized coal. Without being limited by theory, it is believed that the co-firing of the coal with oxygenate functions to reduce the conversion of fuel bound nitrogen to NOx. It is believed that the oxygenated fuel pyrolyzes faster than the coal, thereby consuming oxygen and creating a locally fuel rich zone around the firing source. In this fuel rich zone, it is speculated that nitrogen-containing molecules desorb from the coal and in the absence of excess oxygen, these nitrogen compounds are reduced to $N_2$.

In accordance with the invention, reduced emissions of NOx and particulates are achieved when the pulverized coal is co-fired with a selected oxygenate source.

The NOx-reducing fuel compositions and methods herein may also include a wide variety of other ingredients/steps. The compositions and methods of the present invention are described in detail hereinafter.

A) Pulverized Coal

As used herein, "pulverized coal" refers to a lignite, anthracite and/or bituminous coal that is either already small enough or has been subjected to mechanical particle size reduction such that the resulting "pulverized" material can be conveyed via fluidization with air through a pipe into the combustion chamber of a furnace or boiler.

Preferably, the pulverized coal useful herein is at least 50% under 200 mesh (74 microns), more preferably the coal useful herein is at least 60% under 200 mesh, and even more preferably, at least 70% under 200 mesh.

B) Oxygenate Source

The fuel compositions of the present invention contain an oxygenate source. As used herein, "oxygenate source" refers to an organic compound consisting primarily of hydrogen, carbon and oxygen atoms. Oxygenate sources useful herein include glycerine and/or glycerol derivatives, propylene glycol, propylene glycol derivatives, ethylene glycol, ethylene glycol derivatives, methyl esters of natural fats and oils (biodiesel), fatty alcohols of natural fats and oils, and mixtures thereof.

The natural fats and oils themselves and/or the fatty acids derived from such fats and oils may be optionally added as a secondary oxygenate source to one or more of the oxygenated sources.

In accordance with the invention, reduced emissions of NOx are achieved when pulverized coal is co-fired in a combustion chamber of, for instance, a furnace or boiler, in conjunction with an effective amount of an oxygenate source. Preferably the oxygenate source material is co-fired with the pulverized coal such that the oxygenate source material accounts for from about 2.5% to about 40% on a heat input basis, of the heat output generated. More preferably, the oxygenate source material accounts for from about 10% to about 20%, on a heat input basis, of the heat output generated. Co-firing may occur by blending the oxygenate source with the coal prior to, during, and/or after pulverization, or may be injected into the combustion zone via a separate nozzle.

1. Glycerine and/or Glycerol Derivatives

The oxygenate source of the present invention may be selected from glycerine and/or glycerol derivatives. As used herein, the terms "glycerine" or "glycerol" can be used interchangeably and refer to 1,2,3 hydroxypropane or 1,2,3, propanetriol. Glycerine is typically produced as a co-product from the production of soaps, fatty acids, fatty alcohols and alkyl esters. Glycerine from these sources is commonly referred to as "natural glycerine". Another possible source of natural glycerine is from the hydrogenation or enzymatic conversion of glucose, sorbitol or other sugars to glycerine and other polyols. Yet another source of natural glycerine is to recover it from the waste products of ethanol fermentation. "Synthetic" glycerine is produced from propylene, typically through the allyl chloride to epichlorohydrin process as practiced by Dow Chemical. Glycerine from any source, or combination of sources may be used herein.

The glycerol derivatives preferred for use herein include ethers in which 1 to 3 of the glycerol hydroxyl groups have been etherified. A wide range of olefins may be used to etherify the glycerol. As used herein, "olefin" refers to an unsaturated straight, branched or cyclic hydrocarbon of $C_2$–$C_{10}$. Examples of olefins useful herein include ethylene, propylene, butylenes, isobutylene, pentene, cyclopentene, isopentene, hexane, cyclohexene, 3-methylpentene, 2,2-dimethylbutene, 2,3-dimethyl butene, 1-heptene, 2-heptene, 3-heptene, 1-octene, 2-octene, 3-octene, 4-octene, 1-nonene, 2-nonene, 3-nonene, 4-nonene, 1-decene, 2-decene, 3-decene, 4-decene, 5-decene and the like. $C_2$–$C_6$ olefins are preferred due to their low cost. Mixtures of olefins can be employed, for example if the glycerol were reacted with a mixture of olefins in unpurified form.

A method for etherifying glycerol may be found in U.S. Pat. No. 5,476,971.

Another glycerol derivative that is useful herein is the reaction product of glycerol and acetone having the formula 2,2-dimethyl-1,3-dioxolane-4-methanol, commonly called solketal.

Preferably, the glycerol derivative of the present invention is selected from di t-butyl glycerol ethers, tri t-butyl glycerol ethers, solketal, or mixtures thereof. More preferably, the glycerol derivative is a mixture of di t-butyl and tri t-butyl glycerol ethers comprised roughly of 80% di t-butyl glycerol and 20% tri t-butyl glycerol.

Preparation of the Glycerol Ether

The process for making glycerol ethers is known to those of ordinary skill in the art. Typical catalysts include organic acid catalysts such as para-toluenesulfonic acid, acidic ion exchange resins such as Amberlyst 15 or the class of crystalline metallosilicates known as zeolite catalysts. Catalyst levels should range between 0.1 and 5 wt % of polyol. Typical reaction temperatures range from about 50° C. to about 200° C., preferably from about 50° C. to about 150° C., and more preferably from about 50° C. to about 100° C. Typical reaction pressures range from about 40 psig to about 1000 psig, preferably from about 40 psig to about 300 psig and more preferably from about 50 psig to about 150 psig. Typical olefin:polyol molar ratios range from about 1:1 to about 5:1, preferably from about 2:1 to about 3:1. Typical reaction times are from about 2 to about 24 hours, preferably from about 2 to about 10 hours, and more preferably from about 2 to about 6 hours. Reaction according to this synthesis process proceeds to about 95% polyol conversion. Separation of the mono-, di- and tri-ethers may be accomplished by appropriate steps, such as liquid-liquid extraction.

2. Propylene Glycol and Derivatives

The oxygenate source of the present invention may be selected from propylene glycol or derivatives thereof. Propylene glycol derivatives useful herein include dipropylene glycol and polypropylene glycol having a molecular weight of from about 200 to about 1,000, e.g., polypropylene glycol 400. Other propylene glycol derivatives herein include: glycol ethers such as mono, di, tri propylene glycol butyl ether; mono, di, tripropylene glycol methyl ether; mono, di, tripropylene glycol tertiary butyl ether; mono, di, tripropylene glycol ethyl ether; mono, di tripropylene glycol propyl ether; mono, di, tripropylene glycol pentyl ether; mono, di, tripropylene glycol hexyl ether; and mono, di tripropylene glycol propionate.

3. Ethylene Glycol Derivatives

The oxygenate source of the present invention may be selected from ethylene glycol and derivatives thereof. Ethylene glycol derivatives useful herein include diethylene glycol and polyethylene glycol having a molecular weight of from about 200 to about 1,000, e.g., polyethylene glycol 400. Other ethylene glycol derivatives herein include: glycol ethers such as ethylene glycol monobutyl ether (butyl cellosolve); diethylene glycol monobutyl ether (butyl carbitol); triethylene glycol monobutyl ether; tetraethylene glycol monobutyl ether; ethylene glycol hexyl ether; diethylene glycol hexyl ether; ethylene glycol ethyl ether; ethylene glycol methyl ether; ethylene glycol propyl ether; ethylene glycol pentyl ether; diethylene glycol methyl ether; diethylene glycol ethyl ether; diethylene glycol propyl ether; diethylene glycol pentyl ether; triethylene glycol methyl ether; triethylene glycol methyl ether; triethylene glycol propyl ether; triethylene glycol pentyl ether; triethylene glycol hexyl ether; and ethylene glycol acetate.

4. Fatty Acid Alkyl Esters (Biodiesel)

The oxygenate source of the present invention may be selected from fatty acid alkyl esters, also commonly referred to as "biodiesel" fuels. The term "alkyl" herein refers to a saturated straight, branched or cyclic hydrocarbon of $C_1$–$C_{10}$, and includes methyl, ethyl, propyl, isopropyl, n-butyl, isobutyl, t-butyl, pentyl, cyclopentyl, isopentyl, neopentyl, hexyl, hextyl, octyl, nonyl, decyl and combinations thereof.

A wide range of oils and fats derived from animals and plants may be used as the source of such fatty acid alkyl esters. Examples of oils and fats useful herein include beef tallow, coconut oil, corn oil, cottonseed oil, lard, olive oil, palm oil, palm kernel oil, peanut oil, soybean oil, linseed oil, tung oil, sunflower oil, safflower oil, canola oil, rapeseed oil, sesame oil, babassu oil, perilla oil, oiticica oil, fish oils, menhaden oil, castor oil, chinese tallow tree oil, physic nut oil, cuphea seed oil, microalgal oils, bacterial oils and fungal oils. While a wide range of oils, or mixture of oils, can be used as the source of fatty acid alkyl esters in the present invention, it is particularly applicable to soybean oil, canola oil, rapeseed oil, sunflower oil and recycled (waste) cooking oil or grease.

Preferably, the fatty acid alkyl esters used herein are selected from the methyl esters of soybean oil, yellow grease, rapeseed oil, and mixtures thereof.

5. Fatty Alcohols

The oxygenate source of the present invention may be selected from fatty alcohols of oils and/or fats. A wide range of oils and fats derived from animals and plants may be used as the source of such fatty alcohols. Examples of oils and fats useful herein include beef tallow, coconut oil, corn oil, cottonseed oil, lard, olive oil, palm oil, palm kernel oil, peanut oil, soybean oil, linseed oil, tung oil, sunflower oil, safflower oil, canola oil, rapeseed oil, sesame oil, babassu oil, perilla oil, oiticica oil, fish oils, menhaden oil, castor oil, chinese tallow tree oil, physic nut oil, cuphea seed oil, microalgal oils, bacterial oils and fungal oils. While a wide range of oils, or mixture of oils, can be used as the source of fatty alcohols in the present invention, it is particularly applicable to coconut, palm kernel, palm, tallow, and mixtures thereof.

Optional Secondary Oxygenates

In addition to the oxygenates useful herein, other oil or oil-based additives that contain oxygen, such as fatty-acid still bottoms, may be included in the co-firing herein as secondary oxygenates. Such materials may further reduce NOx emissions.

A wide range of oils and fats derived from animals and plants may be used. Examples of oils and fats useful herein include beef tallow, coconut oil, corn oil, cottonseed oil, lard, olive oil, palm oil, palm kernel oil, peanut oil, soybean oil, linseed oil, tung oil, sunflower oil, safflower oil, canola oil, rapeseed oil, sesame oil, babassu oil, perilla oil, oiticica oil, fish oils, menhaden oil, castor oil, chinese tallow tree oil, physic nut oil, cuphea seed oil, microalgal oils, bacterial oils and fungal oils. Fatty acids derived from any of these oils and/or fats or combinations thereof may be useful herein as secondary oxygenates. While a wide range of oils, or mixture of oils, can be used as the source of fatty acids in the present invention, it is particularly applicable to soybean oil, tallow, recycled (waste) cooking oil or grease.

C) Heat-Producing Unit

As used herein, "heat-producing unit" refers to a combustion unit in which coal is burned to generate heat energy. The heat energy generated may then be used to heat water or produce steam, such as in a boiler or furnace. Suitable heat producing units include furnaces and boilers wherein pulverized coal is burned. This heat can be used to produce steam for driving electricity-producing turbines or to supply heat to operate a manufacturing process or to provide heat for buildings and structures.

The boilers useful in the methods of the present invention will preferably include at least one of the following and may include, for example, an air supply system, water supply and cooling system, a combustion chamber, fuel supply systems, a flue-gas cooling chamber, scrubber, an air induced-draft fan, a stack, or combinations of any two or more of these features.

Preferably, the burner is a low NOx burner wherein the system is already optimized for the lowest NOx emissions possible for use with pulverized coal fuel.

In order to have combustion, there must be one air source available to the burner which is commonly referred to as the "primary air flow." Preferably, there is at least one additional air flow injected downstream of the burner air. Such additional air flow may be a secondary and/or tertiary air flow. These additional air flows may include overfire air, underfire air, curtain air, or mixtures thereof. In a preferred burner/air arrangement, primary air comes into the burner with the coal, secondary and tertiary air follows. Preferably, there is an overfire air downstream that is located a distance away from the burner that is 65% of the distance to the flue gas sampling port. The Stoichiometric Ratio is the actual air/theoretical air for complete combustion of the coal.

In preferred heat-producing units, the burner air is distributed as follows:

Primary, 24% Stoichiometric Ratio (SR)=0.2

Secondary, 25% SR=0.22

Tertiary, 51% SR=0.43

Total air at burner is SR=0.85

The stoichiometric ratio is preferably at least about 0.8 in order to reduce corrosion and/or deposits of undesirable by-products.

D) Co-Firing

The methods of the present invention include co-firing of pulverized coal with an oxygenate source in a heat-producing unit. As used herein, "co-firing" refers to a process or method by which a secondary fuel (here an oxygenate source) is injected into the combustion chamber of a heat-producing unit at the same and/or similar times as a primary (here, pulverized coal) fuel in order to burn at least somewhat concurrently. The two fuels are preferably introduced into the combustion chamber through a separate injection device or system.

Pollutant-emission levels can be maintained at or below regulated limits by evaluating the respective pollutant-emission concentrations produced by the oxygenate and by the coal. The energy producer can then calculate the concentration ratio of the oxygenate and the fuel(s) that will produce a desired emission concentration (e.g., an emission concentration within the regulated limit) for the NOx (or other pollutant) then burn at least that much oxygenate in combination with the pulverized coal. The necessary concentration of the oxygenate may be calculated based on its percentage heat input as a function of the overall (fixed) heat input of the combined fuels. As used herein, the term "co-firing ratio" refers to the percentage of total heat generated from the combustion of the oxygenate source. Preferably, the co-firing ratio of oxygenate source to coal is from about 2.5% to about 50%, preferably from about 10% to about 30%.

In preferred heat-producing units or systems the oxygenate source is in liquid form and is fed through a dual fluid nozzle that atomizes the premixed fuel/air. The liquid port is separated from the coal port, but injected substantially simultaneously.

Optional Method Steps/Modifications

The methods of the present invention do not require additional equipment modifications or after treatment devices such as air-staging, scrubbers, Selective Non-Catalytic Reduction units, or Selective Catalytic Reduction units in order to benefit from the NOx emissions reductions. However, such equipment modifications or after-treatment devices may be incorporated into the methods of the present invention if so desired, to further reduce NOx emissions.

1) Air Staging

The methods of the present invention may optionally include air staging. As used herein, "air staging" refers to the known method of introducing combustion air in "stages" along the combustion zone as opposed to all the air being introduced at the point coal enters the furnace. Several patents describe staged combustion techniques that may further reduce nitrogen oxide emissions from the combustion of fuels containing nitrogen. For example, See, U.S. Pat. No. 3,727,562; U.S. Pat. No. 4,343,606; and references cited therein.

2) Selective Catalytic Reduction Units

Selective Catalytic Reduction Units are a post-combustion NOx-controlling technology that are theoretically capable of providing NOx reductions in excess of 90% (realistically greater than 50% as of today). NOx reductions are achieved by injecting ammonia and/or urea into the flue gas, which then passes through layers of catalyst in a reactor. The ammonia and/or urea react with the NOx on the surface of the catalyst, forming molecular nitrogen and water.

Preferably, the methods of the present invention include a further step of treating the flue gas with an optional modification selected from air staging, selective non-catalytic reduction units, selective catalytic reductions, scrubbers, and combinations thereof. However, any known modification or methodology associated with heat-producing units may be added to the methods of the present invention.

EXAMPLES

To demonstrate an embodiment of this invention, the following system is used:

Combustion system—A pulverized coal combustion test furnace, referred to as the "L1500", is a nominal 5 MM BTU/hr (1.5 MW) furnace designed to simulate commercial combustion conditions. The inner dimensions of the horizontal-fired combustor are 42×42 inches square and 40 feet long. The walls have multiple layered insulation to reduce the temperature from about 3000° F. on the fire-side to below 140° F. on the shell side. The combustor is modular in design, and is made up of 12 sections with numerous access ports and optional cooling panels in each section. This allows the flue gas temperature profile to be adjusted to better simulate commercial equipment. The access ports are used for visual observations, fuel and or air injection, and product sampling.

The overall combustion facility includes the air supply system, water supply system and cooling system, L1500 combustor, fuel supply systems, a flue-gas cooling chamber, scrubber, and induced-draft fan and a stack.

The burner in the L1500 is a low NOx design, having primary, secondary and tertiary air inputs that can be independently controlled in terms of flow rate, preheat temperature and, for the secondary and tertiary air registers, degree of swirl. Overfire air is injected downstream in the furnace.

Coal is injected into the furnace through the center of the burner. The coal injector consists of a 1.5 inch pipe inside a 3-inch pipe. Coal is fed through the annulus between the two pipes; the 1.5-inch pipe acts as a bluff body.

For the tests set out herein, the burner system is modified to allow injection of liquid fuel. A dual-fluid (oil+air) atomizing nozzle is inserted through the 1.5-inch bluff body pipe in the center of the burner so that the tip of the nozzle is set back approximately one inch from the end of the 1.5-inch pipe. Liquid fuel and air are premixed and fed through six small holes in the injector tip. By this design the liquid is well atomized and fed directly into the center of the coal stream.

The liquid fuel is fed from two 10-gallon pressure tanks connected in parallel, Compressed air is applied to the tanks, which forced the liquid out from the tanks, through a digital flow meter and into the burner. Adjusting the air pressure could vary the liquid flow rate.

Analysis System—Samples can be taken from any two locations in the furnace. For the data herein, they are pulled from Section 6 which corresponds to approximately a two second residence time and is representative of an industrial pulverized coal boiler. Samples are also taken at the furnace outlet, corresponding to about 5 seconds residence time. The sampling system included a filter to remove particulate and a chiller to condense out water.

NO and $NO_2$ are measured using a Thermo Environmental Instruments Model 42C High Level Chemiluminescence Analyzer.

$SO_2$ is analyzed using a Western Bovar 721 AT2 analyzer. This analyzer has a range of 0–1000 ppm $SO_2$ which is lower than the level produced in the furnace. Therefore the sampler is diluted 3:1 with nitrogen and the measured $SO_2$ signal is corrected to give the proper value.

PM10 particulate measurements are conducted with the TSI Model 8520 DusTrak Aerosol Monitor. This instrument uses laser scattering to measure the number of particulates smaller than a specific size.

Based upon the use of the combustion system and the analysis system set out above, the following Examples illustrate practice of the invention but without limiting its scope:

As may be seen from the Example tables below, if dilution of the coal NOx emissions by the addition of oxygenates is the only mechanism in operation, the emissions would be expected to decrease linearly with an increasing co-fire ratio. Such a relationship is illustrated by the rates of $SO_2$ emissions. Since the oxygenates contain no sulfur, the $SO_2$ emissions data shows the direct linear response in $SO_2$ emitted as the sulfur containing coal is substituted by sulfur-free oxygenate. However, the NOx and PM10 rates indicate a very different and novel response. As the co-fire ratio of oxygenates is increased, there are unexpectedly disproportionately larger decreases in NOx and PM10 emissions.

A preferred co-fire ratio of 20%, by the heat input, of oxygenate resulted in a 63.4% reduction in NOx and a 95.1% reduction in PM10.

Example 1

| Coal with Oxygenate | |
|---|---|
| Primary fuel: | Illinois #5 coal |
| Oxygenate: | Mixture of 80% di t-butyl and 20% tri t-butyl glycerol ethers |
| Total heat input: | 4 million BTU/hr |
| Burner conditions: | |
| Primary air | 24% of burner air, SR = 0.20 |
| Secondary air | 25% of burner air, SR = 0.22 |
| Tertiary air | 51% of burner air, SR = 0.43 |
| Total air input | SR = 0.85 |
| Overfire air: | SR = 0.30 |
| Total air: | SR = 1.15 |
| Co-firing ratios (heat %) | 2.5, 5, 10, 15, 20, 30, 40 |

Example 1 Resulting Emissions

| Oxygenate Co-fired (by % heat input) | NOx Emissions Lb/MM BTU | NOx % Reduction | $SO_2$ Emissions Lb./MM BTU | $SO_2$ % Reduction | PM10 Emissions Microgm/m3 | PM 10 % Reduction |
|---|---|---|---|---|---|---|
| 0% | 0.631 | 0.0% | 5.28 | 0.0% | 75619 | 0.0% |
| 2.5% | 0.567 | 10.1% | 5.00 | 5.3% | 74918 | 0.9% |
| 5% | 0.550 | 12.9% | 4.88 | 7.4% | 76825 | −1.6% |
| 10% | 0.414 | 34.4% | 4.75 | 10.0% | 54449 | 28% |
| 15% | 0.358 | 43.3% | 4.50 | 14.7% | 16298 | 78.4% |
| 20% | 0.231 | 63.4% | 3.74 | 29.1% | 3708 | 95.1% |
| 30% | 0.197 | 68.7% | 3.50 | 33.7% | 32682 | 56.8% |
| 40% | 0.190 | 69.8% | 2.99 | 43.3% | 41622 | 45.0% |

Example 2

| Oxygenate and Coal | |
|---|---|
| Primary fuel: | Illinois #5 coal |
| Oxygenate: | Soybean Methyl Ester |
| Total heat input: | 4 million BTU/hr |
| Burner conditions: | |
| Primary air | 24% of burner air, SR = 0.20 |
| Secondary air | 25% of burner air, SR = 0.22 |
| Tertiary air | 51% of burner air, SR = 0.43 |
| Total air input | SR = 0.85 |
| Overfire air: | SR = 0.30 |
| Total air: | SR = 1.15 |
| Co-firing ratios (heat %) | 2.5, 5, 10, 15, 20, 30, 40, 50 |

Example 2 Resulting Emissions

| Oxygenate Co-fired (by % heat input) | NOx Emissions Lb/MM BTU | NOx % Reduction | $SO_2$ Emissions Lb./MM BTU | $SO_2$ % Reduction | PM10 Emissions Microgm/m3 | PM 10 % Reduction |
|---|---|---|---|---|---|---|
| 0% | 0.452 | 0.0 | 6.10 | 0.0 | 37217 | 0.0 |
| 2.5% | 0.385 | 14.7 | 5.65 | 7.4 | 43451 | −16.8 |
| 5% | 0.364 | 19.3 | 5.47 | 10.3 | 17068 | 54.1 |
| 10% | 0.349 | 22.8 | 5.50 | 9.7 | 22734 | 38.9 |
| 15% | 0.344 | 23.7 | 5.32 | 12.7 | 17509 | 53.0 |
| 20% | 0.292 | 35.3 | 5.19 | 14.9 | 11279 | 69.7 |
| 30% | 0.312 | 30.9 | 4.26 | 30.1 | 11004 | 70.4 |
| 40% | 0.207 | 54.1 | 3.70 | 39.2 | 5021 | 86.5 |
| 50% | 0.175 | 61.2 | 3.12 | 48.9 | 3014 | 91.9 |

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fuel composition providing reduced emissions of NOx when combusted, said composition comprising:

a) pulverized coal; and b) an oxygenate comprising a glycerol derivative selected from the group consisting of glycerol ethers in which 1 to 3 of the glycerol hydroxyl groups have been etherified and mixtures thereof.

2. A fuel composition providing reduced emissions of NOx when combusted, said composition comprising:

a) pulverized coal; and b) and oxygenate comprising a glycerol derivative selected from the group consisting of di t-butyl glycerol ethers, tri t-butyl glycerol ethers, solketal, and mixtures thereof.

* * * * *